US008418648B2

(12) United States Patent
Maly et al.

(10) Patent No.: US 8,418,648 B2
(45) Date of Patent: Apr. 16, 2013

(54) METHOD AND DEVICE FOR PRODUCTION OF A LAYER OF NANOPARTICLES OR A LAYER OF NANOFIBRES FROM SOLUTIONS OR MELTS OF POLYMERS

(75) Inventors: Miroslav Maly, Visnová (CZ); David Petras, Pertoltice (CZ); Ladislav Mares, Liberec (CZ)

(73) Assignee: El Marco S.R.O. (CZ)

( * ) Notice: Subject to any disclaimer, the term of this patent is extended or adjusted under 35 U.S.C. 154(b) by 555 days.

(21) Appl. No.: 12/526,578

(22) PCT Filed: Jan. 30, 2008

(86) PCT No.: PCT/CZ2008/000015

§ 371 (c)(1),
(2), (4) Date: Aug. 10, 2009

(87) PCT Pub. No.: WO2008/098526

PCT Pub. Date: Aug. 21, 2008

(65) Prior Publication Data

US 2010/0028553 A1 Feb. 4, 2010

(30) Foreign Application Priority Data

Feb. 12, 2007 (CZ) ..... PV2007-108

(51) Int. Cl.
*B05B 5/025* (2006.01)

(52) U.S. Cl.
USPC ..... 118/621; 118/630; 118/634

(58) Field of Classification Search ..... 118/620–640, 118/308; 425/174.8 E, 505; 427/457–486, 427/180
See application file for complete search history.

(56) References Cited

U.S. PATENT DOCUMENTS

| | | | | |
|---|---|---|---|---|
| 2,698,814 | A | 5/1955 | Ransburg | |
| 2009/0148547 | A1 * | 6/2009 | Petras et al. | 425/174.8 E |

FOREIGN PATENT DOCUMENTS

| | | | |
|---|---|---|---|
| CZ | 294 274 | | 11/2004 |
| CZ | PV 2006-477 | | 7/2006 |
| DE | 101 36 255 | A1 | 2/2003 |
| EP | 0 258 016 | A | 3/1988 |
| EP | 1 059 106 | A1 | 12/2000 |
| EP | 1 595 845 | A | 11/2005 |
| WO | WO 94/07609 | A | 4/1994 |
| WO | WO 97/22416 | A | 6/1997 |

(Continued)

OTHER PUBLICATIONS

International Search Report dated Nov. 4, 2008, issued in corresponding international application No. PCT/CZ2008/000015.
Office Action for European Application No. 08 706 719.5 mailed Jul. 5, 2010.

*Primary Examiner* — Yewebdar Tadesse
(74) *Attorney, Agent, or Firm* — Ostrolenk Faber LLP

(57) ABSTRACT

Method for production of deposit or layer of nanoparticles or a layer of nanofibers from solutions or melts of polymers in electrostatic field of a high intensity, during which the produced nanoparticles or the produced nanofibers deposit on a substrate material passing through the active chamber, in which is positioned the active electrode. The electrostatic field for production, transfer and depositing of nanoparticles or production, transfer and depositing of nanofibers is induced between the active electrode and the substrate material, on which in the direction of its movement in front of and/or opposite to the active electrode there is applied an electric charge of opposite polarity than that of the active electrode, while an electric charge applied on the substrate material is being partially or totally consumed through depositing of nanoparticles or nanofibers on the moving substrate material.

4 Claims, 3 Drawing Sheets

FOREIGN PATENT DOCUMENTS

| | | | |
|---|---|---|---|
| WO | WO 2005/024101 | | 3/2005 |
| WO | WO 2005024101 | A1 * | 3/2005 |
| WO | WO 2008/011840 | A2 | 1/2008 |
| WO | WO 2008/023093 | | 2/2008 |

* cited by examiner

METHOD AND DEVICE FOR PRODUCTION OF A LAYER OF NANOPARTICLES OR A LAYER OF NANOFIBRES FROM SOLUTIONS OR MELTS OF POLYMERS

CROSS REFERENCE TO RELATED APPLICATIONS

The present application is a 35 U.S.C. §371 National Phase conversion of PCT/CZ2008/000015, filed Jan. 30, 2008, which claims benefit of Czech Application No. PV2007-108, filed Feb. 12, 2007, the disclosure of which is incorporated herein by reference. The PCT International Application was published in the English language.

TECHNICAL FIELD

The invention relates to the method for production of a layer of nanoparticles or a layer of nanofibres from solutions or melts of polymers in electrostatic field of a high intensity, during which the produced nanoparticles or the produced nanofibres deposit on a substrate material passing through the active chamber, in which is positioned the active electrode.

The invention also relates to the device for production of a layer of nanoparticles or a layer of nanofibres from solutions or melts of polymers, comprising an active chamber, in which there are positioned opposite one to another the active electrode connected with a source of high voltage and a substrate material coupled with means for initiating its forward motion.

BACKGROUND ART

The collecting electrodes used at present to create electrostatic field usable for production of nanofibres from polymer solutions and melts are designed first of all as simple sheet-metal, metallic plates. Such electrodes meet the condition for creation of electric field, nevertheless only in terms of quantity. For the production process of nanofibres through the method of electrostatic spinning in a larger than laboratory scale it is essential, that electric field meets also concrete qualitative parameters.

According to DE 101 36 255 A1 the spinning electrode is formed by a system of spinning wires arranged parallel between two mutually parallel endless belts, guided between the upper and lower cylinders, which are arranged one above another. The spinning wires in the lower section extend into a reservoir of polymer solution. Opposite to a section of spinning electrode carrying out the polymer solution from reservoir there is arranged a collecting electrode formed by an electrically conductive circulating belt of wire netting or of metallic foil. A surface of collecting electrode adjacent to the spinning electrode is larger than the respective surface of spinning electrode. Spinning electrode and collecting electrode are connected to opposite poles of the source of high voltage, so that an electrostatic field is induced between them, which serves for spinning of polymer solution carried out into electric field on spinning wires. The produced fibres are deposited on a substrate fabric, which is guided on surface of collecting electrode. At this device, the electric field is induced between individual spinning wires of spinning electrode and the surface of collecting electrode, while the spinning wires move in the direction from the reservoir of polymer solution upwards and an electric field of each spinning wire moves together with it. In this case, the disadvantage is especially the mutual influencing of electric fields of individual spinning wires, because all spinning wires have the same polarity and voltage. On borders of electrically conductive belt or foil forming the collecting electrode so called triple points are formed, a corona is generated and, as a result of it the defects in homogeneity of electric field occur between the spinning and collecting electrode, the defects at forming the fibres in electric field and unevenness in transport of fibres to the substrate material laying on a whole surface of the collecting electrode.

DE 101 36 255 A1 further in the claim 8 and in the paragraph 16 discloses the possibility to use two spinning electrodes, as described above, arranged one against another, and between them, in the position of collecting electrode, there is positioned or guided the fabric. Spinning electrodes have an opposite polarity and the fibres produced on spinning electrodes deposit from each side to one surface of the fabric with opposite charge, which remain bound in the fibres. It is obvious, that electric field for electrostatic spinning is induced between both spinning electrodes and the fibres due to their opposite charges are attracted one to another and deposit on opposite sides of the fabric. Inducing of a homogenous electric field at this embodiment is nearly impossible and according to a current experience the described device either would not be working at all or irregularly and for a very short period.

EP1 059 106 A1 discloses the device for electrostatic spinning of polymer solutions, at which the spinning electrodes are formed by a system of nozzles or a system of discs and the collecting electrode is formed by a conductive endless driven belt, which is grounded. Electric field at this embodiment is induced between the spinning electrodes and a section of conductive endless belt situated against the corresponding spinning electrode. The disadvantages of this embodiment are the same as of the belt-type collecting electrode according to DE 101 36 255 A1 described above.

CZ patent 294 274 discloses the rotating spinning electrode of a cylindric elongated shape. Around a section of circumference of the spinning electrode there is arranged the collecting electrode in a shape of a semi-cylinder made of perforated sheet metal, on whose inner circumference there is guided the substrate material, which is pressed to the inner surface of the collecting electrode due to underpressure in the space behind the collecting electrode. This arrangement is complicated from the point of view of the function, as it is very probable, that during motion of the substrate material this will be taken away from the inner surface of the collecting electrode, and due to this an uneven depositing of fibres will occur on surface of substrate material. At the same time such collecting electrode shows disadvantages in a case if considerably electrically non-conductive substrate or carrying materials are used. Either an electric field induced between the cylindrical spinning electrode and a semi-cylinder collecting electrode will not be homogenous, because in the middle section of the cylindric spinning electrode an electric field will have a lower intensity than on borders, while non-homogeneity will further be supported by occurrence of so called triple points on borders of the collecting electrode, and very probably also on borders of holes for air passage through the sheet metal of the collecting electrode.

Next to this, CZ 294 274 discloses the plate and rod-shaped electrodes, which are due to the spinning electrode positioned behind the substrate material, which does not touch their surfaces. Electric field is induced between the cylindrical spinning electrode and individual rods forming the collecting electrode. Resultant electric field is not homogenous and may be unstable in time. In a course of the process and on the nanofibrous layer this will show itself especially by a drop and increase in irregularity of performance.

To overcome these disadvantages, the collecting electrode according to PV 2006-477 has been designed, which contains a conductive thin-walled body of electrode, in which there is performed at least one opening on whose circumference there is arranged a border, while in an inner space of electrode body there is positioned at least one holder of electrode connected with at least one brace fastened in the spinning chamber, while the holder of electrode is arranged behind the border of opening and is electrically non-conductive.

The advantage of such construction of the collecting electrode is that it does not contain any sharp shapes or shapes with high curvature, and that the points where three differently dielectric solid environments (triple points) are coming into contact, are hidden into the electrode body, where the electric field has zero intensity. Consequently the result is that the electrode does not produce corona and thus an electric field, which is co-induced together with other electric elements, is affected only by the geometry of the electrode. This fact contributes markedly to that the electric field may be much more better adjusted and controlled.

The disadvantage of collecting electrodes according to the background art is first of all a problematic method of creation and deposition of nanofibres and nanoparticles from polymer solutions and melts in cases, when very non-conductive substrate material is used, e.g. electrostatic non-modified hydrophobic polypropylene spunbonds and meltblowns. The relative material and production complexity of these electrodes should be mentioned as well.

The goal of this invention is to suggest a production method of a layer of nanoparticles or layer of nanofibres, which would remove the disadvantages of background art, and thus contribute reliably to creation of defined and stable electrostatic field of a required intensity on process electrodes in areas, where the process of production of nanoparticles from polymer solutions or melts or spinning of polymer solutions or melts is initiated and ran. The invention especially solves the problem with usage of extremely non-conductive substrate materials, because it enables the nanoparticles or nanofibres to be deposited on such materials during electrostatic spinning.

The goal of the invention is also construction of a device for such type of production which would be simple and especially reliable on a long-term basis.

THE PRINCIPLE OF INVENTION

The goal of the invention has been reached through the method for production of a deposit or layer of nanoparticles or a layer of nanofibres according to the invention, whose principle consists in that, the electrostatic field for production, transfer and depositing of nanoparticles or production, transfer and depositing of nanofibres is induced between the active electrode and the substrate material, on which in the direction of its movement in front of and/or opposite the active electrode in a contactless way there is applied an electric charge of opposite polarity than that of the active electrode, while an electric charge applied on the substrate material is being partially or totally consumed through depositing of nanoparticles or nanofibres on moving substrate material.

The advantage of this method is especially the possibility to use even considerably non-conducting substrate or carrying material.

According to the claim 2 an electric charge is applied on the substrate material by means of a corona emitter.

The corona emitter positioned opposite to initiation electrode of opposite polarity creates in its close vicinity a stream of correspondingly charged particles along its whole length and in the direction to initiation electrode. Therefore by guiding the substrate material in vicinity of such emitter, between this emitter and initiation electrode, upon preserving a constant distance from the corona emitter, an uniform quantity of the charge is being deposited on the substrate material along its whole width, as a result of which inducing of homogenous electrostatic field between the substrate material and initiation electrode is secured. If the corona emitter is positioned opposite to the active electrode, the initiation electrode is represented by the active electrode. As a result of homogenous electrostatic field the creation of deposit or layer of nanoparticles or layer of nanofibres is also homogenous along the width as well as length on substrate materials on textile basis with higher or smaller degree of conductivity.

By means of standard technical elements for discharging of charged textile materials it is then possible, if it is necessary, to remove the possible remaining charge.

The principle of device for production of deposit or layer of nanoparticles or layer of nanofibres according to the invention consists in that, the substrate material being in an active chamber without contact with any charged and/or grounded means contains quantity of electrical charge of opposite polarity than the active electrode being sufficient to induce electrostatic field of high intensity between the active electrode and substrate material.

As already said in other words above, it is advantageous, that on substrate material after impact of nanoparticles or nanofibres, a total or partial compensation of the charge of substrate material occurs by the charge brought by the charged processed material, thus by nanofibres or nanoparticles.

According to the claim 5 it is at the same time advantageous, if in active chamber behind the substrate material opposite to the active electrode there is positioned the corona emitter of opposite polarity than that of active electrode, while the trajectory of substrate material is passing through the field of radiation of corona emitter.

According to the claim 6 it is advantageous, if the corona emitter of opposite polarity than active electrode is positioned in front of the active chamber on one side of substrate material, while against the corona emitter on opposite side of substrate material there is positioned the initiation electrode of a polarity identical with active electrode, and the trajectory of substrate material is passing through the field of radiation of corona emitter.

At the same time in case of positioning of corona emitter in direction of substrate material in from of active chamber it is advantageous, if an electrostatic field of identical or opposite orientation with respect to electrostatic field is induced between the active electrode and substrate material.

Advantageous is a homogenous charging of substrate material with a charge opposite with respect to active electrode, which in result contributes to creation of homogenous layer of nanofibres or nanoparticles of deposit.

This electrostatic field in active chamber is with advantage induced between the corona emitter and active, in this case simultaneously the initiation, electrode on opposite side of substrate material, while the substrate material is guided through the radiation field of corona emitter, i.e. in its close vicinity, but does not touch it.

The advantage is that this variant combines the functions of electrostatic fields for process of depositing the layer of nanofibres or nanoparticles on a substrate material itself and for charging the substrate material.

It is also advantageous if this electrostatic field before the active chamber is induced by a corona emitter positioned on one side of substrate material, opposite to which, on the second side of substrate material, there is positioned corona non-producing initiation electrode, while the substrate material is guided through the radiation field of corona emitter, i.e. in its close vicinity, but does not touch it.

The corona emitter must always produce a charge of opposite polarity than that of active electrode, on which initiation of production of nanoparticles or nanofibres from polymer solution or melts occurs.

In case of positioning in front of entry into active chamber, the corona emitter may be, according to structural and/or technological requirements to the device, positioned with respect to the active electrode on the same or opposite side of substrate material. Nevertheless there must always be the initiation electrode opposite to it.

Advantageous is variability of structure of spinning device or the device for production of nanoparticles and from it resulting possibility of its technically as well as economically optimum arrangement.

The corona emitter must meet the criteria of corona emitters, i.e. it must contain elements with high curvature. With advantage, very thin elongated units with circular diameter, i.e. wires or cords may be used.

A low price and technical simplicity of such corona emitter is its advantage.

It is also advantageous if the corona emitter is mounted perpendicular to the direction of motion of substrate material symmetrically parallel to the longitudinal axis of active electrode.

Such arrangement secures homogenous application of electrical charge on substrate material and as a result of it also homogeneity of electrostatic field and homogeneity of deposit or layer of applied nanoparticles or homogeneity of layer of deposited nanofibres.

DESCRIPTION OF THE DRAWING

The device according to the invention for production of layer of nanoparticles or layer of nanofibres from solutions or melts of polymers is schematically shown in a drawing, where.

EXAMPLES OF EMBODIMENT

The invention will be hereinafter described on example of embodiment of a device for production of layer of nanofibres from solutions of polymers, at the same time it is apparent to those skilled in the art, that the same conditions for induction and function of electrostatic field are between active electrode and collecting electrode of any device for production of nanofibres or nanoparticles in electrostatic field of high intensity, and so, at all such devices instead of a collecting electrode positioned with respects to the active electrode opposite to it and behind substrate material, it is possible to use a substrate material containing a sufficient quantity of electrical charge of opposite polarity than active electrode.

Figure 1:
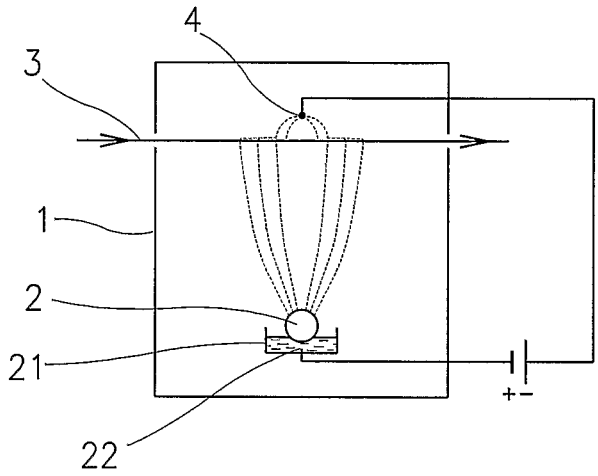
FIG. 1 represents a basic embodiment alternative of active/spinning chamber comprising active/spinning electrode and the corona emitter, FIG. 2 embodiment according to the FIG. 1 comprising more corona emitters, FIG. 3 to FIG. 6 embodiment comprising the same active/spinning chamber and to it pre-arranged auxiliary chamber, while according to the FIG. 3 the corona emitter is in an auxiliary chamber positioned with respect to corona emitter of active/spinning chamber on the same side of substrate material, according to the FIG. 4 the corona emitter is in an auxiliary chamber positioned on opposite side of substrate material, the FIG. 5 and FIG. 6 correspond to the FIG. 3 and FIG. 4, while in the active/spinning chamber there is not positioned active/spinning electrode.

The FIG. 1 schematically represents a cross section of the device for electrostatic spinning of polymer solution, which comprises the spinning chamber 1, in which is positioned the spinning electrode 2, produced according to the CZ 294274. The spinning electrode 2 is formed by an elongated cylindrical body, which is rotatably mounted in the reservoir 21 of polymer solution 22 and with a section of its circumference is immersed in this polymer solution. In a suitable distance from the spinning electrode 2 there is arranged a travel for guiding the substrate material 3, which is passing through the spinning chamber 1. With respect to the spinning electrode 2 behind the substrate material 3 against the spinning electrode 1 there is arranged the corona emitter 4, which is in the shown embodiment formed by a cord or wire or other cylindric body of a small diameter and is positioned parallel with axis of rotation of the spinning electrode 2 perpendicular to the direction of motion of substrate material 3 along the whole width of substrate material 3.

The spinning electrode 2 is in a known manner connected to one pole of high voltage source, for example +20 to +80 kV, to whose second pole is connected the corona emitter 4. The corona emitter 4 may also be grounded. The corona emitter 4 is mounted in a suitable distance from the substrate material 3, while any contact of corona emitter 4 and substrate material 3 is absolutely avoided. Length of corona emitter 4 corresponds to the length of spinning electrode. The substrate material 3 is through the spinning chamber 1 transported in a known manner, for example by means of not shown feeding rollers and delivery rollers. The spinning electrode 2 may be formed by any other known manner, e.g. by a rotating spinning electrode according to CZ PV 2005-360 or CZ PV 2005-545 or a nozzle electrode according to WO 03/080905 A1. In the same way, the corona emitter may be formed by any other known corona emitter, e.g. a rod with tips, etc.

During operation is between the corona emitter 4 and spinning electrode 2 induced an electric field, through acting of which the corona emitter 4 along its whole length in its close vicinity creates a radiation field, so called corona, formed by a stream of correspondingly charged particles of opposite polarity, than that of the spinning electrode 2, while these particles are directed to the spinning electrode 4 and impact on the substrate material 3. Due to the fact that the substrate material 3 during its passage through the spinning chamber 1 is passing the radiation field of corona emitter 4 and is in the same distance from it along the whole width, there is deposited on the substrate material 3 along its whole width an uniform quantity of the charge of opposite polarity, than that of the spinning electrode. This charge is on the surface of the substrate material further distributed in the direction as well as against the direction of movement of the substrate material 3. Electrostatic field for spinning is induced between the spinning electrode 2 and the substrate material 3, respectively its section, which contains a sufficient quantity of electrical charge for inducing of electrostatic field of a high intensity.

As a result of this is between the substrate material 3 and the spinning electrode 2 induced a homogenous electrostatic field of a high intensity, which ensures homogenous applying of layer of nanofibres on a substrate material along its whole width and simultaneously ensures also the length homogeneity of a layer of applied nanofibres. Electrical charge applied on the substrate material 3 is through depositing of nanofibres on the moving substrate material 3 partially or totally consumed.

To increase the quantity of produced nanofibres it is advantageous to arrange several spinning electrodes 2 along the length of spinning area one after another, while against them there are arranged corona emitters 4.

Figure 2:
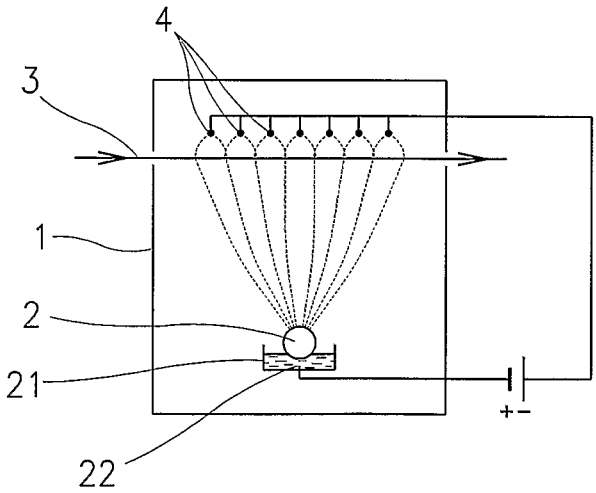

To provide a sufficient quantity of electrical charge on the substrate material 3 is advantageous the embodiment according to the FIG. 2, which comprises several corona emitters 4 positioned along the length of spinning space one after another.

Figure 3:
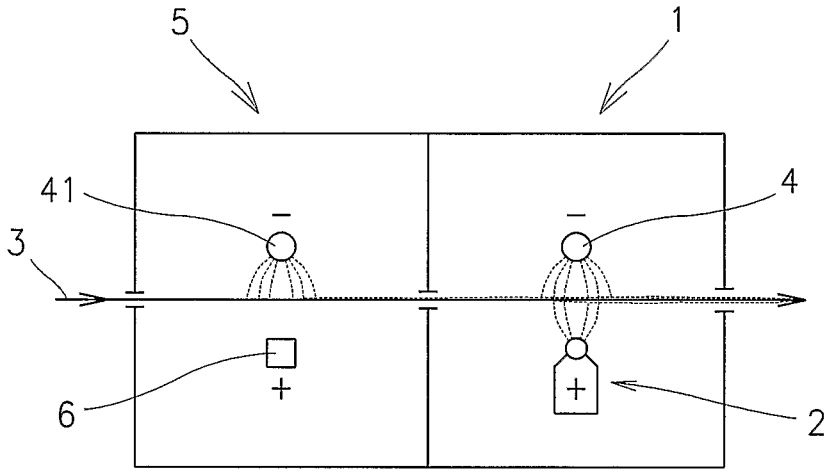
Figure 4:
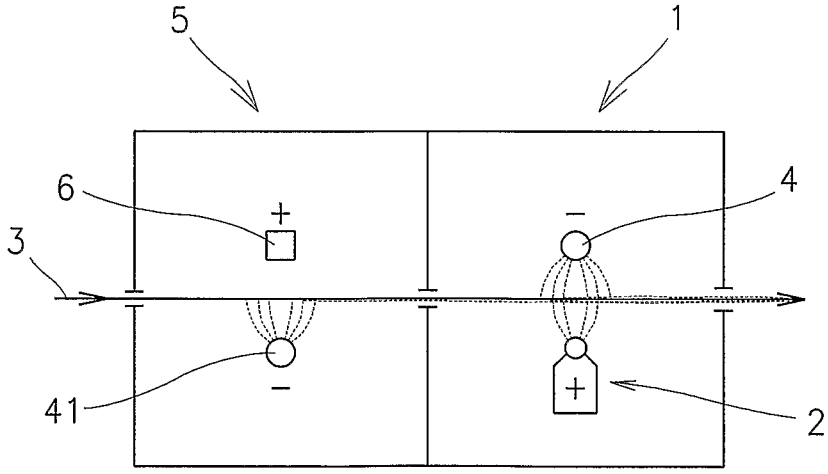

Another method how to increase the quantity of electrical charge on the substrate material 3 is shown in the FIG. 3 and FIG. 4, at which in the direction of motion of the substrate material 3 in front of the spinning chamber 1, there is arranged an auxiliary chamber 5, comprising corona emitter 41 and initiation electrode 6 arranged opposite to the corona emitter 41 on opposite side of substrate material 3. The substrate material is in the auxiliary chamber 5 guided in vicinity of the corona emitter 41, and so it is passing through the field of its radiation. The corona emitter 41 may be formed by any suitable corona emitter, as in the above mentioned embodiments. The initiation electrode 6 is formed by any electrode of a sufficient length without corona.

In embodiment according to the FIG. 3 the corona emitter 41 is in auxiliary chamber 5 positioned on the same side of substrate material 3 and it is connected to the same potential as the corona emitter 4 in the spinning chamber 1, while the initiation electrode 6 is positioned on the same side of substrate material 3 and it is connected to the same potential as the spinning electrode 2. The radiation field of corona emitter 41 in auxiliary chamber 5 has a charge of the same polarity as the radiation field of corona emitter 4 in the spinning chamber 1 and so the quantity of electrical charge on substrate material 3 is therefore increasing.

In embodiment according to the FIG. 4 the corona emitter 41 is in auxiliary chamber 5 positioned on the same side of substrate material 3 as the spinning electrode 2, and the initiation electrode 6 is positioned on the opposite side of the substrate material 3. At the same time the corona emitter 41 in auxiliary chamber is connected with the source of high voltage of an opposite polarity than the spinning electrode 2, and the initiation electrode 6 has the same polarity as the spinning electrode 2.

During operation an electric field is induced between the corona emitter 41 in the auxiliary chamber 5, through acting of which the corona emitter 41 creates in its close vicinity the radiation field formed by a stream of correspondingly charged particles of opposite polarity than that of the spinning electrode 2, while these particles are directed to the initiation electrode 6 and impact on the substrate material 3. The substrate material 3 before entry into the spinning chamber 1 comprises a substantial quantity of electrical charge of opposite polarity than the spinning electrode 2, at the same time there is brought still another quantity of electrical charge from the corona emitter 4 in the spinning chamber 1.

Figure 5:
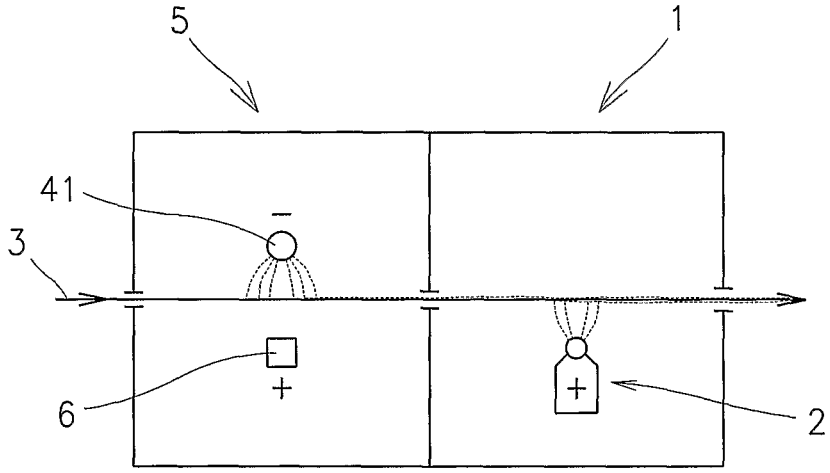
Figure 6:
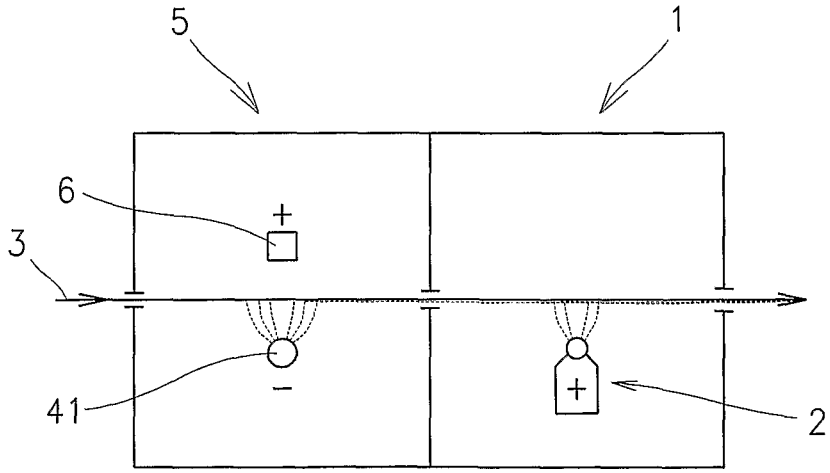

Another variant of the device according to the invention is represented in the FIG. 5 and FIG. 6 and is based on the above mentioned embodiments according to the FIG. 3 and FIG. 4. In these embodiments, there is not positioned any corona emitter either collecting electrode in the spinning chamber 1. In the spinning chamber 1 there is only spinning electrode 2 and the substrate material 3. The corona emitter 41 is positioned only in the auxiliary chamber 5, in which there is positioned also the corresponding initiation electrode 6. In embodiment according to the FIG. 5 the corona emitter 41 and initiation electrode 6 in the auxiliary chamber 5 are arranged in the same way as in the embodiment according to the FIG. 3. In embodiment according to the FIG. 6 the corona emitter 41 and initiation electrode 6 in the auxiliary chamber 5 are arranged in the same way as in the embodiment according to the FIG. 4. Also their function is identical as in embodiment according to the FIG. 3 and FIG. 4. According to this variant of embodiment the substrate material 3 enters the spinning chamber 1 with quantity of electrical charge of opposite polarity than the spinning electrode 2 sufficient for creation of electrostatic field of high intensity between the spinning electrode 2 and the substrate material 3.

As already mentioned above, any device for production of nanofibres or nanoparticles in electrostatic field of a high intensity may be arranged in the same manner, while it is not important what spinning electrodes or other active electrodes are used, which serve for transportation of the spinning material, formed by polymer solution or melt of polymer. In the following text, therefore for the spinning chamber and chamber for production of nanoparticles the collective name active chamber will be used, for the spinning electrode and electrode for production of nanoparticles the collective name the active electrode will be used, for the spinning space and a area for production of nanoparticles the collective name active area will be used.

After depositing the nanoparticles or nanofibres on the substrate material 3 in most cases it is advantageous, if after exiting the substrate material 3 with deposited layer or deposit of nanoparticles or nanofibres the electrical charge is consumed by the charge delivered by nanofibres or nanoparticles from active electrode to the substrate material 3. Nevertheless in practice the substrate material 3 frequently remains charged with surplus of non-consumed charge, what in case of nonconducting substrate material 3 means, that the substrate material 3 further remains charged with residual charge.

If the nanofibres or nanoparticles are deposited according to the invention on non-conductive substrate material 3, for example electrostatic non-modified hydrophobic polypropylene spunbonds and meltblowns, it is advantageous to take away the surplus charge from the substrate material 3. Therefore with advantage there is arranged not represented grounding electrode behind the active chamber, which is in contact with substrate material 3 exiting the active chamber. Through this grounding electrode the surplus electrical charge is taken away from the substrate material 3.

The advantage of the method and device for production of deposit or layer of nanoparticles or layer of nanofibres from solutions or melts of polymers according to the invention is the possibility of its electrostatic applying on practically non-conducting substrate materials 3. By means of relatively inexpensive corona emitter 4, 41 an homogenous distribution of the charge on the substrate material 3 could be achieved, and consequently creation of homogenous layer of nanofibres or deposit or layer of nanoparticles. Variability in arrangement of electrostatic fields enables optimum adaptation of the device according to the properties of entry semi-products and requirements as to the final product.

LIST OF REFERENTIAL MARKINGS

1 spinning chamber
2 spinning electrode
21 reservoir of polymer solution
22 polymer solution
3 substrate material
4 corona emitter in the spinning chamber
41 corona emitter in the auxiliary chamber
5 auxiliary chamber
6 initiation electrode

What is claimed is:

1. A device for production of a layer of nanofibres from solutions or melts of polymers comprising an active chamber, in which there are one opposite to another positioned an active electrode connected to a high voltage source and a substrate material coupled with means for initiating forward motion of the substrate material, wherein in the active chamber behind the substrate material opposite to the active electrode there is positioned at least one corona emitter of opposite polarity than the active electrode, while the trajectory of the substrate material is passing through the field of the at least one corona emitter.

2. The device according to the claim 1, wherein the at least one corona emitter is formed by at least one elongated body of circular diameter.

3. The device according to the claim 2, wherein the at least one corona emitter is formed by a cord.

4. The device according to claim 2, wherein the at least one corona emitter is positioned perpendicular to the direction of motion of the substrate material parallel to longitudinal axis of active electrode.

* * * * *

UNITED STATES PATENT AND TRADEMARK OFFICE

CERTIFICATE OF CORRECTION

PATENT NO. : 8,418,648 B2
APPLICATION NO. : 12/526578
DATED : April 16, 2013
INVENTOR(S) : Maly et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 555 days.

Signed and Sealed this
First Day of September, 2015

Michelle K. Lee

Michelle K. Lee
*Director of the United States Patent and Trademark Office*